US005549179A

United States Patent [19]

Herkel et al.

[11] Patent Number: 5,549,179

[45] Date of Patent: Aug. 27, 1996

[54] COST EFFECTIVE CONTROL OF THE MAIN SWITCHES OF AN ELEVATOR DRIVE MOTOR

[75] Inventors: Peter L. Herkel; Hans K. Spielbauer, both of Berlin, Germany

[73] Assignee: Otis Elevator Company, Farmington, Conn.

[21] Appl. No.: 189,400

[22] Filed: Jan. 31, 1994

[51] Int. Cl.[6] ..... B66B 1/06

[52] U.S. Cl. ..... 187/298; 187/287; 187/391

[58] Field of Search ..... 187/287, 277, 187/289, 298, 316, 391, 393, 280

[56] References Cited

U.S. PATENT DOCUMENTS 4,367,810 1/1983 Doane et al. ..... 187/29 R 4,898,263 2/1990 Manske et al. ..... 187/133

5,392,879 2/1995 Boyce et al. ..... 187/393

FOREIGN PATENT DOCUMENTS 4-45085 2/1992 Japan ..... 187/105

*Primary Examiner*—Robert Nappi

[57] ABSTRACT

The main disconnects for energizing a drive motor for an elevator may be controlled by a circuit having a safety chain, an inspection device, a circuit board and a coil for the main disconnect wherein the safety chain provides a safe condition signal to the inspection device which in turn provides a plurality of mode signals to the circuit board which evaluates the mode signals in order to provide a circuit breaker control signal to the circuit breaker coil. In turn, the circuit breaker coil either opens or closes the main disconnect.

1 Claim, 3 Drawing Sheets

COST EFFECTIVE CONTROL OF THE MAIN SWITCHES OF AN ELEVATOR DRIVE MOTOR

TECHNICAL FIELD

The present invention relates to elevators and, more particularly, to control of the motor main switches.

BACKGROUND OF THE INVENTION

The main switches, for example SW1, SW2, of a VF drive (variable frequency and variable voltage on the motor side) such as shown in FIG. 2 are controlled, first by the safety elements in a safety chain 6 shown in FIG. 3, second by inspection and recovery buttons and switches within a so called Inspection-Emergency Recovery (INS-ERO) box 8 (having inspection and recovery switches inside), and third by a control board 10, such as a printed circuit board with hard-wired discrete logic or with the drive control software on it. The meanings of the symbols shown within the board 10 are the same as identified in FIG. 1. Except for the control board 10 of FIG. 3, all elements are electrical safety devices according to the known European safety code EN81-1. It should be mentioned that the inspection mode or devices will include also a corresponding mode or device for a recovery run.

To fulfill the requirements setup in EN81-1 the chapter 14.1.2 "electric safety devices" has to be met, especially point 14.1.2.1.3., i.e., "Apart from exceptions permitted in this standard, no electric equipments shall be connected in parallel with an electric safety device."

Also to be met is point 14.1.2.1.5., i.e., "An output signal emanating from an electric safety device shall not be altered by an extraneous signal emanating from another electric device placed further down the same circuit, which would cause a dangerous condition to result."

The conventional method to fulfill the requirements in EN81-1 is done with the use of the additional relays U and D shown in FIG. 3, which is an expensive method. This method has also the disadvantage, in case of an inspection run: a hangup or stuck condition of the contacts of the U or D relay will keep the main switches SW1 and SW2 activated, although the inspection buttons are released. This error has to be detected by other means, such as an MSD (main switch disconnect) input in order to react upon the release of the inspection button by decelerating and stopping the drive.

DISCLOSURE OF INVENTION

The object of the present invention is to find a cost effective solution without any loss in the safety of the drive.

According to the present invention, the main disconnects for energizing a drive motor for an elevator may be controlled by a circuit having a safety chain, an inspection device, a circuit board and a coil for the main disconnect wherein the safety chain provides a safe condition signal to the inspection device which in turn provides a plurality of mode signals to the circuit board which evaluates the mode signals in order to provide a circuit breaker control signal to the circuit breaker coil. In turn, the circuit breaker coil either opens or closes the main disconnect.

The plurality of mode signal may comprise a normal mode signal and up and down signals, each of which has a status which is monitored by the circuit board by way of software or discrete logic.

The circuit board itself may include a plurality of level converters responsive to the plurality of mode signals for providing converted mode signals to the signal processor which, in turn, provides gating signals to up level converters that trigger high voltage switches resident on the circuit board and responsive to the up and down signals for providing one or the other thereof to at least one disconnect coil.

In further accord with the present invention, the plurality of level converters that are responsive to the plurality of mode signals may be connected to a common return line that is also used as a return line for the at least one circuit breaker coil.

The present invention allows the fulfillment of the requirements of EN81-1, points 14.1.2.1.3 and 14.1.2.1.5 without the need for expensive U and D relays, as in the prior art. In other words, it does this without connecting any electric equipment in parallel with an electric safety device and by ensuring that all upward signals emanating from an electric safety device is not altered by an extraneous signal emanating from another electric device placed further down the same circuit, which would cause a dangerous condition to result. It also removes the problem of the prior art whereby a stuck contact of the U or D relay would keep the main disconnects activated without further checking steps being made necessary. All of this has been done in a cost effective manner without any loss in the safety of the drive.

These and other objects, features and advantages of the present invention will become more apparent in light of a detailed description of a best mode embodiment thereof which follows, as illustrated in the accompanying drawing.

BEST MODE FOR CARRYING OUT THE INVENTION

The solution of the problem is described in the context of the above described prior art, i.e., by means of an example of a VF drive. It should be understood, however, that in principle it can be applied to any type of elevator drive.

Figure 1:
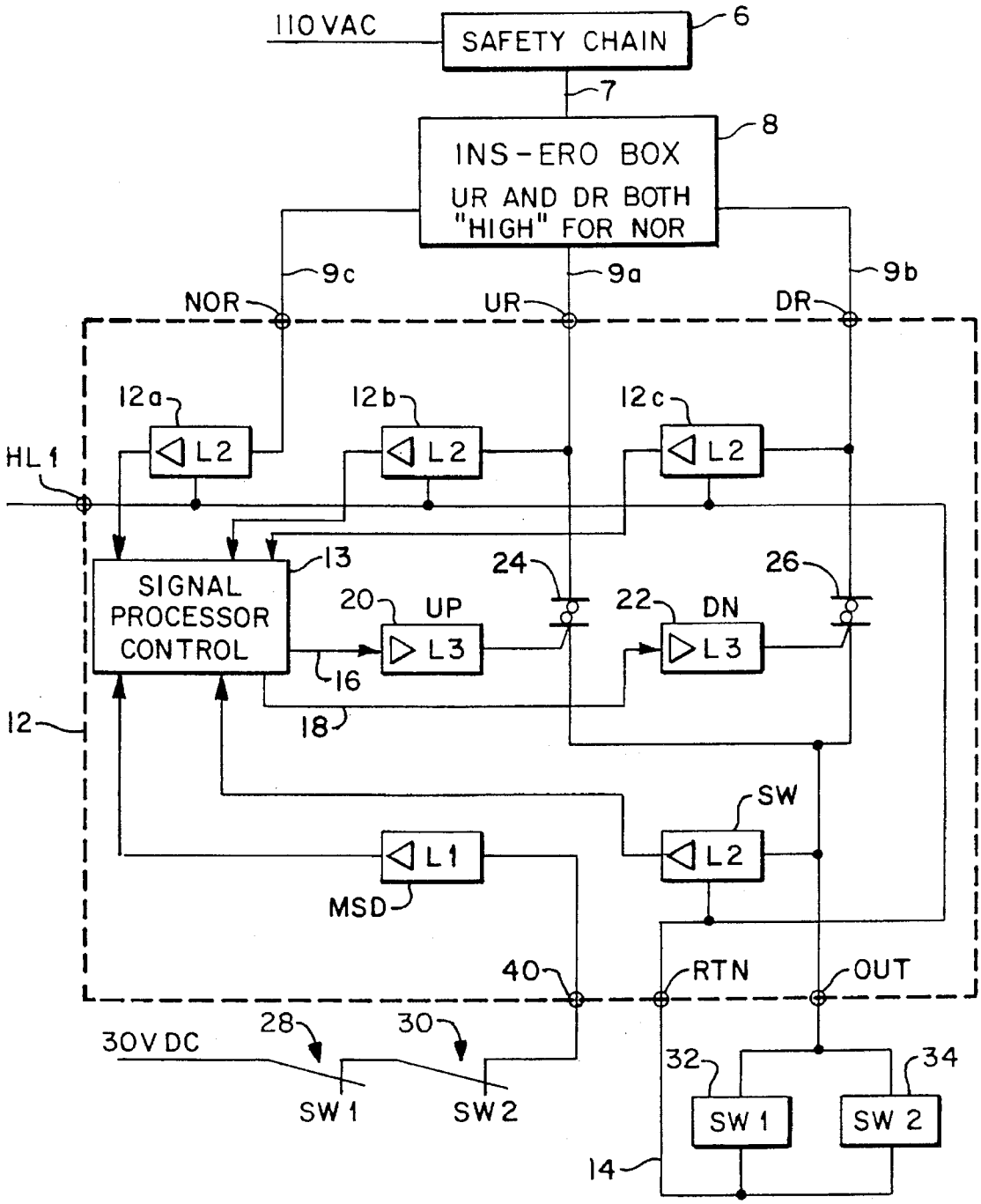
FIG. 1 shows a circuit arrangement for controlling elevator main drive switches, according to the present invention, embodied on a circuit board.

FIG. 1 shows a new overall hookup, according to the present invention, for the safety chain 6, the INS-ERO box 8, the main switches SW1, SW2, and a control board 12. The control board 12 is newly designed, according to the present invention, to be used downstream of the safety chain without causing any dangerous condition to result, as will be shown below in detail. This sort of a hookup was never possible before the present invention.

The outputs of the safety devices, i.e., outputs 7 of the safety chain 6 itself and outputs *9a*, *9b*, *9c* of the INS-ERO box 8 are fed into the control board 12, which uses these inputs to control the main switches. Although the Control PCB (printed circuit board) 12 is certainly designed according to Annex H of the above mentioned safety code EN81-1, it is to be noted that there are no U and D relays present.

The input signals 9*a*, 9*b*, 9*c* to the control board are 12 the outputs of safety devices, UR and DR and NOR (not shown) within INS-ERO box 8. These take the form of UR, DR and NOR signals on the lines 9*a*, 9*b*, 9*c*, respectively. These signals have significance as explained more fully below. Each of the NOR, UR and DR input nodes on the board are connected to L2 type level converters 12*a*, 12*b*, 12*c* for converting the input voltage from the inspection box 8 to a level suitable for a signal processor 13 which evaluates the states of the input signals in order to determine whether the disconnect switch should be open or shut. It controls the opening or closing of the disconnects by way of output signals 16, 18 to up (UP) and down (DN) level converters (L3) 20, 22 connected to a pair of triacs 24, 26 as shown. The triacs 24, 26 are connected on their input sides to the UR and DR input nodes and on their outputs to an output node (OUT). An additional "main switch disconnected" (MSD) level converter (L1) provides a signal to the signal processor 13 indicative of a disconnected condition whenever, for example, a pair of normally closed contacts 28, 30 of coils 32, 34 provide 30 VDC to the input of the MSD level converter. An additional switch (SW) status level converter (L2) is connected to the output (OUT) node at its high voltage side and to the return input and output nodes (RTN, HL1) at a low voltage side for providing a signal to the signal processor 13 whenever the output node (OUT) is in a high voltage status, i.e., whenever the output node is energized, for whatever reason.

Referring back to the mode signals from the INS-ERO box 8, only UR is "high", i.e., its potential is the 110 V of the safety chain power supply, in case of an inspection run in upward direction (see Table 1). Only DR is "high" in case of an inspection run in downward direction. UR and DR are both "high" when the elevator is switched to Normal operation mode (neither inspection nor recovery mode). Of course, the opposite level from "high" is "low", i.e., an open potential disconnected from any supply.

The NOR input indicates the Normal operation mode. It is used only as a redundant information input, since the Normal operation mode is primarily indicated by both UR and DR having "high" input level. Thus, the redundant information about the mode the elevator is set to may be gained by another way.

For every drive mode NOR, UR, DR of FIG. 1 there exists a specific combination in the input signals that have the significance shown in Table 1:

TABLE 1

| NOR | UR | DR | Significance |
|---|---|---|---|
| low | low | low | open safety chain |
| low | low | high | Inspection run down |
| low | high | low | Inspection run up |
| low | high | high | illegal |
| high | low | low | illegal |
| high | low | high | illegal |
| high | high | low | illegal |
| high | high | high | Normal run mode |

The main disconnect switches SW1 and SW2 of FIG. 1 will be closed upon activation of the UP or DN output level-converters of FIG. 1, by virtue of the coils 32, 34 being energized. This occurs in the Inspection run down and run up modes and in the Normal run mode.

The fourth input SW is used to survey the state of the other input and output level converters. In addition, it is used to activate the particular control, such as the VF-control of FIG. 1 after the closing of the main switches and to stop the VF-control before the dropping of the main switches. This will increase the lifetime of the main switches, since by this method they are activated with current less.

An input node 40 (main switch disconnected) is used, as in the prior art, to check the dropping of the main switches required by EN81-1 Chapter 12.7.3.

To comply with sentence 14.1.2.1.3 of EN81-1, a return wire 14 of the coils 32, 34 of main switches SW1, SW2 of FIG. 1 is led though the Control PCB 12 connecting to all input level converters L2, as illustrated. A short-circuit of a level converter L2 will short-circuit the supply for the coils of the main switches, so they will drop. A local interruption of the return lead upon the PCB will also result in a dropping of the main switches.

To comply with sentence 14.1.2.1.5., it is required that the Control PCB 12 shall not alter the output of the safety devices—safety chain and INS-ERO-box—in a way causing a dangerous condition. This means, inter alia, that the Control PCB 12 may not be able to close the main switches in case of an open safety chain or released inspection button in inspection mode. But the PCB may keep the main switches dropped even though the safety chain is closed and in inspection mode a button is pressed.

In order to close the main switches SW1, SW2, the Control PCB 12 uses the voltage which is fed in by one of the two inputs UR and DR. This voltage depends on the safety chain 6 and the buttons and switches in the INS-ERO-box 8. If the safety chain 6 is open or the inspection button is released, the supply voltage for the main switches is absent. An induction of another voltage can be excluded according to EN81-1, since the minimum spacing in the circuits on the Control PCB is more than the required 4 mm, and the breakthrough voltage of the used opto-couplers within the input and output level converters is more than the required 5 kV.

The following failure analysis demonstrates the safe working of the Control PCB 12. The analysis includes a malfunction of the input level converters UR, DR, NOR and SW and a malfunction of the output level converters UP and DN.

1. UR or DR input converter shows constantly high (i.e., the output of the converter has constantly logic high level independent of the voltage level on the input side at the UR or DR plug of the PCB): in normal and inspection mode the failure will be recognized after every run; the safety chain will be opened by the doors or the released inspection button and the all inputs UR, DR, SW and NOR must show low level.

2. UR or DR input converter shows constantly low: in normal mode the failure is recognized, since the inputs UR, DR and NOR must show high level before every run; in inspection mode the failure will be recognized before a run the input is corresponding to (UR for upward, DR for downward), the Control PCB will not initiate an inspection run; the other direction is not a dangerous condition.

3. UR or DR input converter has inverted level (i.e., the converter shows a low level when the input voltage has high level and vice versa): in normal mode the failure will be recognized, since all inputs UR, DR and NOR must show the same level. In inspection mode the failure will be recognized: when the inspection button is pressed no run will be initiated because of missing UR or DR input command, when the button is released the main switches can not be closed because of missing voltage.

4. SW input converter shows constantly high: the failure will be recognized, missing voltage at the inputs of UR or DR has to be seen also on SW input.

5. SW input converter shows constantly low; after closing the main switches by activation of UP or DN the SW input must show a high level, so the failure is recognized.

6. SW input converter has inverted level: obviously the failure is recognized in any case.

7. MSD input converter shows constantly high: the failure is recognized, since after the closing of the main switches this input must show low level.

8. MSD input converter shows constantly low: the failure is recognized after releasing the main switches.

9. MSD input converter has inverted level: obviously the failure is recognized in any case.

10. UP or DN output converter is constantly interrupting: no run can be initiated, missing high input level of SW after activation of UP or DN.

11. UP or DN output converter is constantly conductive: the main switches will close directly after the safety chain is closed or the inspection button is pressed without the activation of UP or DN. The inputs SW and MSD will show this failure condition.

Figure 4:
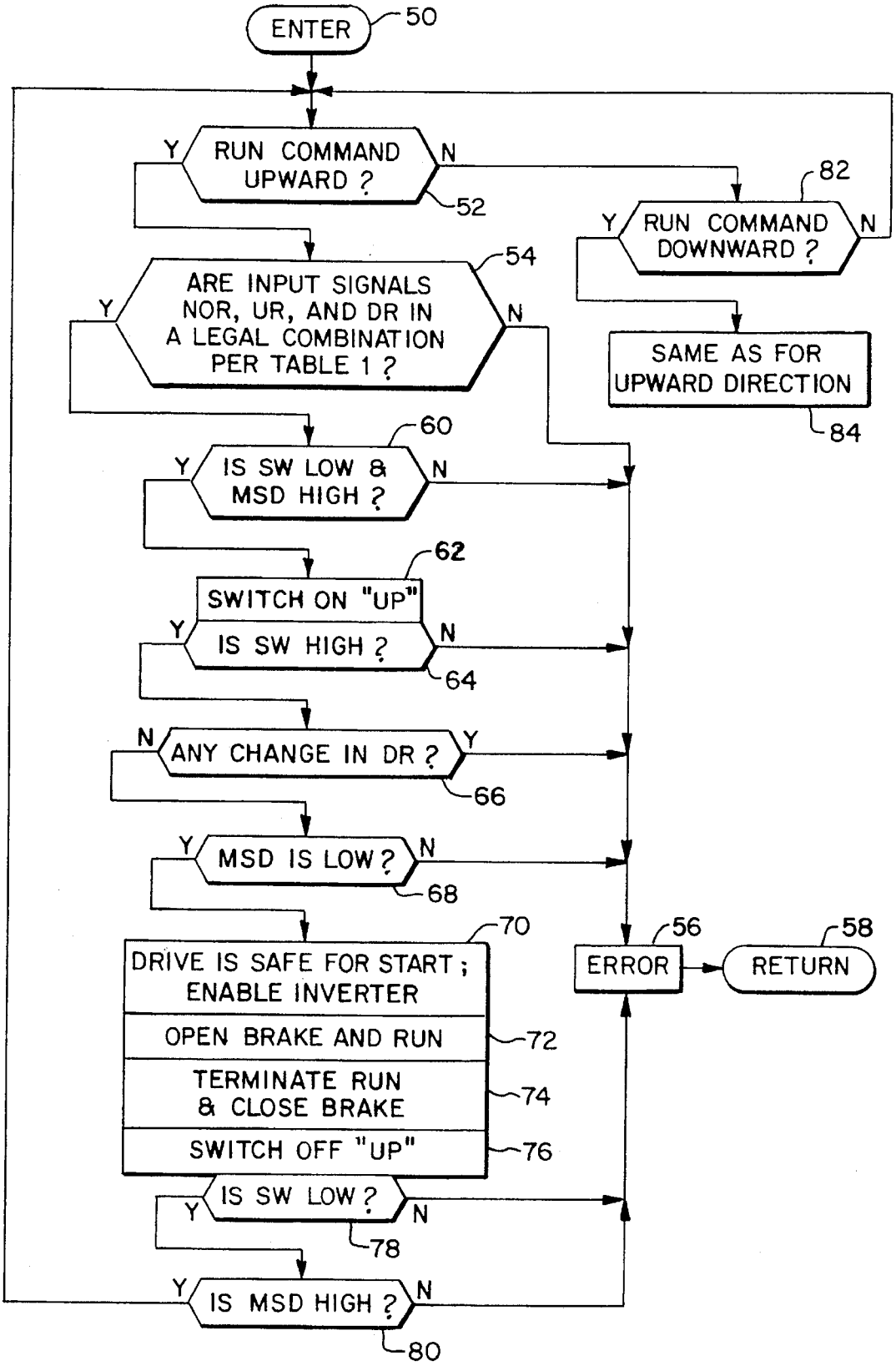
FIG. 4 is a simplified flow chart of a series of steps that may be carried out by the method of the present invention.

Referring now to FIG. 4, a simplified flow chart of a series of steps that may be carried out by the method of the present invention, for example, on the signal processor 13 of FIG. 1, is shown. After entering in a step 50, a determination is made in a step 52 as to whether or not an upward run command is present or not. If so, a step 54 is next executed to determine if the input signals on the lines 9*a*, 9*b*, 9*c* of FIG. 1 corresponding to nodes UR, DR, and NOR nodes, respectively, are in a combination that is legal according to Table 1. If not, an error is declared in a step 56 and a return is made in a step 58, as shown. If, on the other hand, the input signals are in a legal combination, a step 60 is next executed to determine if the output of the level converter SW is low and the output of the level converter MSD is high. If not, an error is declared in step 56 and a return made in step 58. If so, the up converter 20 is switched on in a step 62. This just means that the normally closed contacts 28, 30 are closed because neither of the coils 32, 34 are energized yet and there is no energization of the OUT node yet either. So in this case, it is okay to energize the triac 24 to prepare for executing the run command. This means that the coils 32, 34 will then be energized and the main disconnects SW1, SW2 of FIG. 2 will be closed, although the inverter is not yet enabled.

Figure 2:
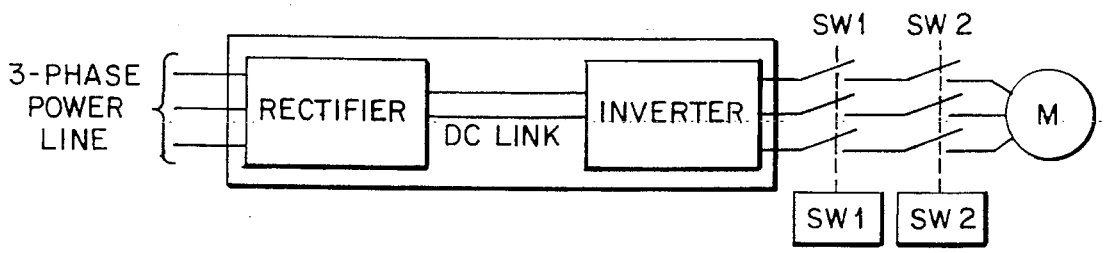
FIG. 2 PRIOR ART
FIG. 2 shows a VF drive arrangement of the prior art which shows main drive switches that may be controlled, according to the present invention, by the circuit arrangement of FIG. 1.
Figure 3:
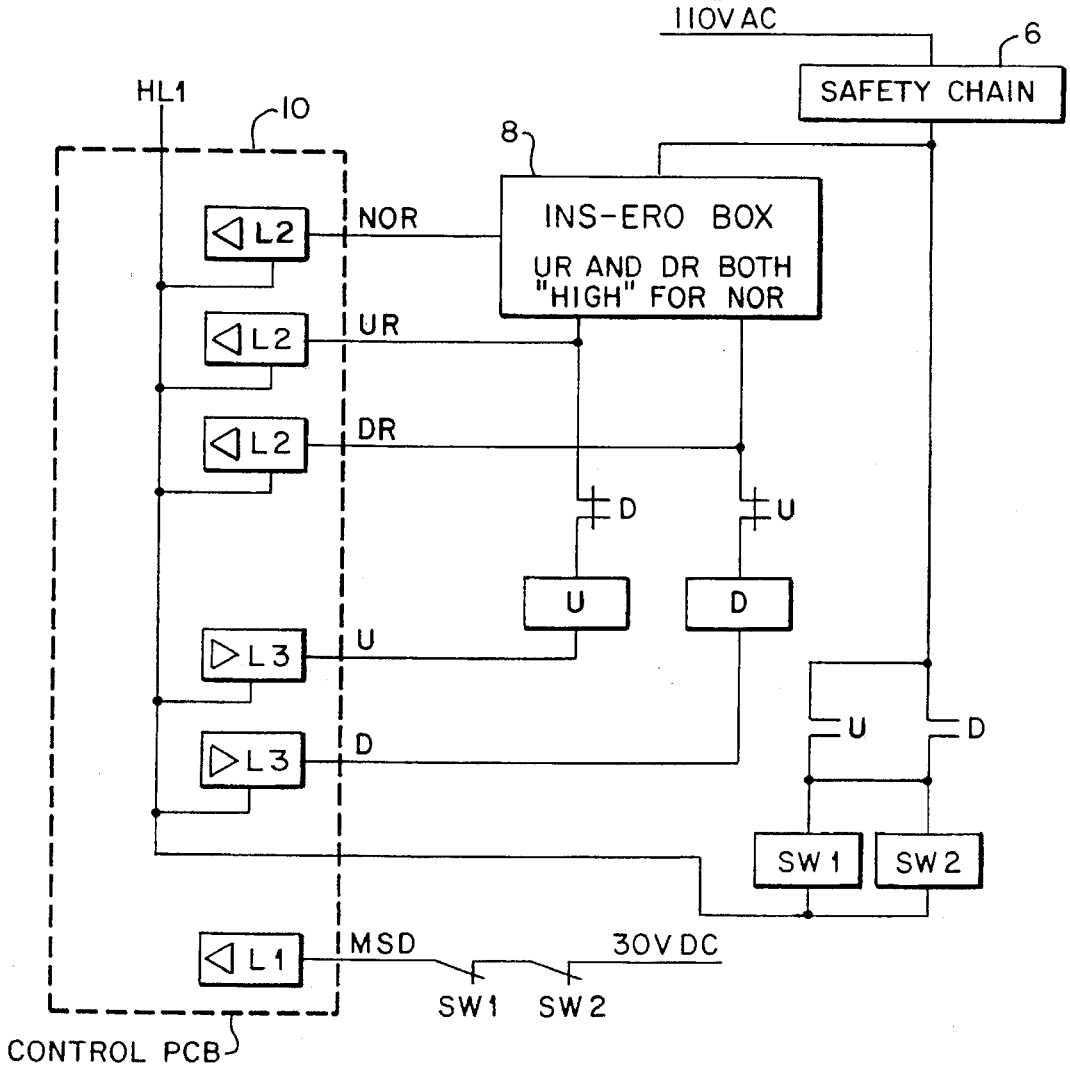
FIG. 3 PRIOR ART
FIG. 3 shows a prior art circuit arrangement for controlling the switches of FIG. 2.

A step 64 is next executed to determine if the output of the level converter SW has switched to a high condition on account of the triac 24 now being in a conductive state. If not, there is a problem and an error is declared in the step 56 and a return made in the step 58. If so, the output of the level converter SW is as expected and a step 66 is next executed to determine if there has been any change in the DR input. If so, there is a problem and an error is declared in the step 56 and a return made in the step 58. If no change is detected in the DR input, then a determination is made in a step 68 if the output of the MSD level converter has gone low, which it should have on account of the normally closed contacts 28, 30 having opened. If not, there is a problem and an error is declared in the step 56 and a return made in the step 58. If MSD has changed to a low state, which it should have, a step 70 is next executed in which the inverter of FIG. 2 is enabled. This causes the motor to run in the upward direction and the elevator controller (not shown) is then able to open the brake and run in accordance with whatever profile is desired, as indicated in a step 72. Once the elevator reaches the desired floor, the run is terminated as indicated in a step 74 and the brake closed. The signal processor 13 of FIG. 1 then shuts off the up converter 20, as indicated in a step 76 and a determination is made in a step 78 as to whether or not the level converter SW has changed to a low state or not after deenergizing the up level converter 20. If not, there is a problem and an error declared in the step 56 and a return made in the step 58. If SW level converter has in fact changed to a low level then a determination is then made in a step 80 as to whether or not the MSD level converter has changed to a high state in response to the coils 32, 34 becoming deenergized after the triac 24 is shut off. If not, an error is declared in the step 56 and a return made in the step 58. If the MSD level converter has in fact gone to a high state then the step 52 is re-executed as before, and so on.

If the step 52 determines that there is no upward run command, then a determination is made in a step 82 as to whether or not there is a downward run command present. If so, a series of steps 84 are executed in a manner similar to the steps 54–80 already described for the upward direction except this time for the downward direction. The only change would be that instead of switching on the up level converter 20 in step 62, the down level converter 22 will be switched on instead in a step comparable to step 62. Similarly, a step similar to step 76 would switch off the down level converter 22 at the appropriate time after determination of the downward run.

If, on the other hand, the step 82 determines that there is no downward run command either, then the steps 52, 82 are re-executed until either an upward or downward run command is detected.

Although the invention has been shown and described with respect to a best mode embodiment thereof, it should be understood by those skilled in the art that various changes, omissions, and deletions in the form and detail of the foregoing may be made therein without departing from the spirit and scope of the invention.

We claim:

1. An elevator control method, comprising the steps of:

determining a presence of a run upward or run downward command and, in the presence thereof, determining an existence of a legal combination of a plurality of signals from an inspection controller and a safety chain including at least an up run condition signal and a down run condition signal and, in the presence of the legal combination, determining that a main disconnect has not been controlled to a closed condition;

controlling the main disconnect to a closed condition;

determining that the main disconnect has been controlled to the closed condition;

providing electrical power to the disconnect and running the elevator upward or downward until a run is completed;

removing electrical power from the main disconnect and controlling the main disconnect to an open condition; and determining that the main disconnect has been controlled to the open condition.

* * * * *